US006904875B2

(12) United States Patent
Kilger

(10) Patent No.: US 6,904,875 B2
(45) Date of Patent: Jun. 14, 2005

(54) METHOD FOR ADJUSTING COOLANT TEMPERATURE IN AN INTERNAL COMBUSTION ENGINE

(75) Inventor: Michael Kilger, Abensberg (DE)

(73) Assignee: Siemens Aktiengesellschaft, Munich (DE)

( * ) Notice: Subject to any disclaimer, the term of this patent is extended or adjusted under 35 U.S.C. 154(b) by 26 days.

(21) Appl. No.: 10/477,426

(22) PCT Filed: Apr. 30, 2002

(86) PCT No.: PCT/DE02/01574

§ 371 (c)(1),
(2), (4) Date: Nov. 13, 2003

(87) PCT Pub. No.: WO02/092975

PCT Pub. Date: Nov. 21, 2002

(65) Prior Publication Data

US 2004/0144340 A1 Jul. 29, 2004

(30) Foreign Application Priority Data

May 14, 2001 (DE) ..... 101 23 444

(51) Int. Cl.[7] ..... F01P 7/14
(52) U.S. Cl. ..... 123/41.1
(58) Field of Search ..... 123/41.1, 41.09

(56) References Cited

U.S. PATENT DOCUMENTS 6,662,761 B1 * 12/2003 Melchior ..... 123/41.44

* cited by examiner

*Primary Examiner*—Andrew M. Dolinar
*Assistant Examiner*—Katrina Harris
(74) *Attorney, Agent, or Firm*—Morrison & Foerster LLP

(57) ABSTRACT

A method for adjusting coolant temperature in an internal combustion engine (2), whereby the coolant circuit thereof contains an electrically driven coolant pump (3) and an electrically controllable bypass valve (4). If the setpoint value of the coolant temperature changes in an abrupt manner, the rotating speed of the coolant pump (3) rises during the short interval in order to reduce the dead time required for adjustment. A Smith controller, which takes into account dead times of the system, is used to regulate the bypass valve.

7 Claims, 4 Drawing Sheets

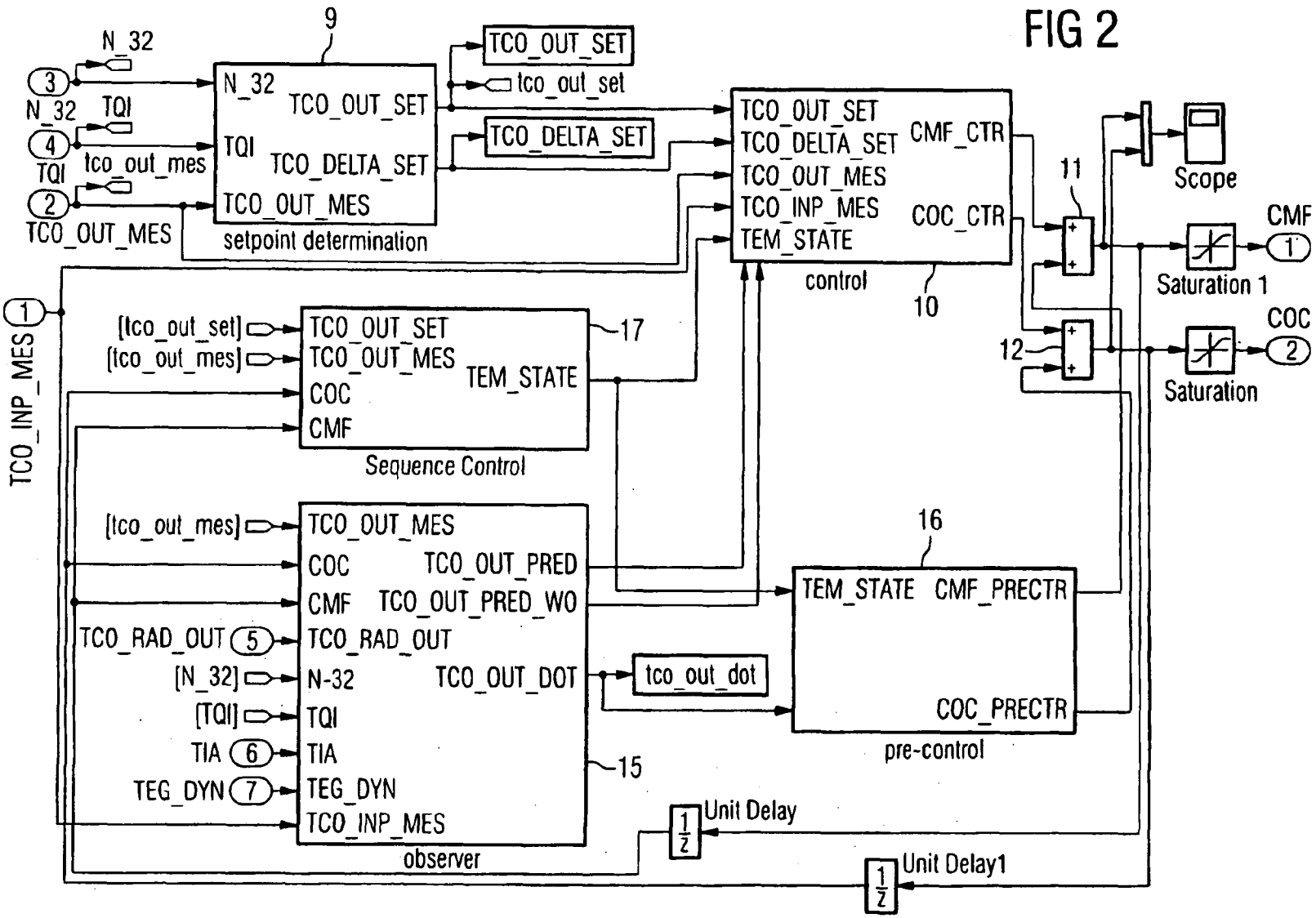
FIG 2
Scope
CMF
Saturation 1
COC
Saturation
11
12
10
TCO_OUT_SET
TCO_DELTA_SET
TCO_OUT_MES
TCO_INP_MES
TEM_STATE
CMF_CTR
COC_CTR
control
16
TEM_STATE
CMF_PRECTR
COC_PRECTR
pre-control
Unit Delay1
Unit Delay
tco_out_dot
TCO_OUT_SET
tco_out_set
TCO_DELTA_SET
9
N_32
TQI
TCO_OUT_SET
TCO_DELTA_SET
TCO_OUT_MES
setpoint determination
17
TCO_OUT_SET
TCO_OUT_MES
COC
CMF
TEM_STATE
Sequence Control
15
TCO_OUT_MES
COC
CMF
TCO_OUT_PRED
TCO_OUT_PRED_WO
TCO_RAD_OUT
N-32
TQI
TIA
TEG_DYN
TCO_INP_MES
TCO_OUT_DOT
observer
N_32
TQI
tco_out_mes
TCO_OUT_MES
[tco_out_set]
[tco_out_mes]
[tco_out_mes]
TCO_RAD_OUT
[N_32]
[TQI]
TIA
TEG_DYN
TCO_INP_MES

METHOD FOR ADJUSTING COOLANT TEMPERATURE IN AN INTERNAL COMBUSTION ENGINE

CLAIM FOR PRIORITY

This application claims the benefit of priority to international application PCT/DE02/01574, which was filed on Apr. 30, 2002 and published in the German language on Nov. 21, 2002, which application claims benefit to German application DE 10123444.9, filed May 14, 2001.

TECHNICAL FIELD OF THE INVENTION

This invention relates to a method for controlling the coolant temperature in an internal combustion engine coolant circuit with an electrically driven coolant pump and an electrically controllable bypass valve which routes a variable part of the coolant flow through a bypass line containing a radiator.

BACKGROUND OF THE INVENTION

Instead of a conventional thermostat valve and a conventional coolant pump driven mechanically by the internal combustion engine, this method uses an electrically controlled bypass valve and an electrically driven coolant pump. In this case, the rotational speed of the coolant pump and the setting of the bypass valve are regulated as a function of the coolant temperature at the outlet of the internal combustion engine and by the difference between the coolant temperatures at the outlet and inlet of the internal combustion engine.

With this method the rotational speed of the coolant pump can be minimized to keep the energy consumption of the coolant pump as low as possible. However, the resulting restricted flow rate of the coolant results in relatively large idle times of the system. This is particularly serious if the bypass valve is located in the vicinity of the outlet of the internal combustion engine. This results in very long delays until the coolant is available at the inlet of the internal combustion engine (e.g. for cooling the internal combustion engine) after the setting of the bypass valve has been changed. In the case of short-term increases in load, such as those that occur, for example, when a motor vehicle fitted with this arrangement is involved in overtaking, this may lead to the coolant not reaching the inlet of the internal combustion engine until the overtaking process has already ended.

SUMMARY OF THE INVENTION

The invention discloses a method for controlling the coolant temperature of the generic system described above in such a way that the idle times of the system are taken into account and where possible reduced.

One aspect of the invention provides for the rotational speed of the coolant pump to be briefly increased in the case of abrupt changes to the setpoint of the coolant temperature. For this purpose, the controller for the rotational speed of the coolant pump preferably includes a PD element as the pre-controller. This will increase the flow rate of the coolant accordingly so that it is available more quickly at the inlet of the internal combustion engine. Increasing the rotational speed of the pump for a short time causes only slight additional energy consumption.

According to a second aspect of the invention which can be provided in conjunction with the first aspect, a Smith controller for controlling the position of the valve is used which uses an observer in the form of a model of the coolant circulation and the heat dissipated by the internal combustion engine to continuously estimate the idle time of the system so as to generate estimated coolant temperature values of an imaginary system without idle time which will be used to regulate the valve setting. Smith controllers are well-known per se, cf. e.g. "Matlab" and "Simulink", example-oriented introduction in the simulation of dynamic systems, Addison-Wesley 1998, pp. 353–358. Compared with conventional controllers, the Smith controller has the advantage that it can also take into account large idle times to prevent large stationary errors in regulation.

The idle time of the system is usefully estimated as a function of the coolant flow and the heat dissipation of the internal combustion engine, in which case the heat dissipation can be estimated as a function of the rotational speed and the volumetric efficiency of the internal combustion engine.

BRIEF DESCRIPTION OF THE DRAWINGS

An exemplary embodiment of the invention is shown on the basis of the drawings, in which:

FIG. 2 shows a block diagram of a control system for controlling the coolant temperature.

DETAILED DESCRIPTION OF THE INVENTION

Figure 1:
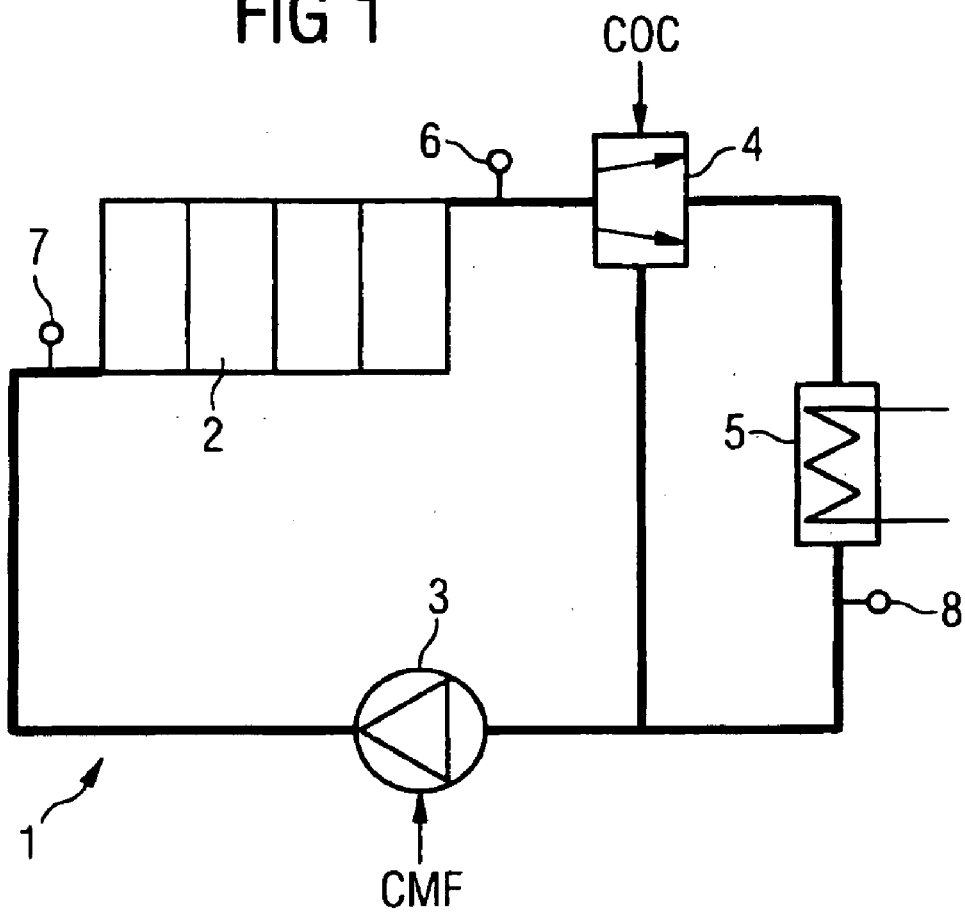
FIG. 1 shows a block diagram of a coolant circuit.

FIG. 1 is a schematic representation of the coolant circuit 1 of an internal combustion engine 2. The coolant circuit 1 includes a coolant pump 3 and a bypass valve 4. The coolant pump 3 is an electrically driven pump, for example, a radial pump of which the rotational speed can be controlled. The bypass valve 4 that routes the coolant flow coming from the internal combustion engine 2, depending on its position, through the radiator 5 or passing radiator 5 to the coolant pump 3 is a distributing valve whose position can be controlled electrically in which case, as a function of the setting of the bypass valve 4, a greater or lesser coolant flow is routed through the radiator 5.

FIG. 1 further shows temperature sensors 6, 7 and 8 by means of which the coolant temperature is detected at the outlet and inlet of the internal combustion engine 2 as well as at the outlet of the radiator 5. However, it should be pointed out that no separate temperature sensor is required for detecting the coolant temperature at the inlet of the internal combustion engine 2 since this temperature can also be calculated or estimated by means of other operating parameters. The temperature sensor 8 at the outlet of the radiator 5 is also not absolutely necessary and sensors for detecting further operating parameters such as, for example, the rotational speed of the internal combustion engine are not shown.

In order to control the coolant temperature of the coolant circuit 1, the rotational speed of the coolant pump 3 and the position of the bypass valve 4 are regulated by means of the control signals CMF and COC. The control signals COC and CMF are regulated as a function of the coolant temperature at the outlet of the internal combustion engine and by the difference between the coolant temperatures at the outlet and inlet of the internal combustion engine. In order to generate the control signals CMF and COC, the control system shown in FIGS. 2 and 3 can be used, in which case reference should be made to the list appended as an annex as regards the abbreviations used in these figures.

The control system shown in FIG. 2 has a prespecified setpoint 9 that, on the basis of the identification fields and as a function of the input signals N 32 (rotational speed of the internal combustion engine), TQI (torque of the internal combustion engine) and TCO OUT MES (actual value of the coolant temperature at the internal combustion engine outlet), generates the requires value signals TCO OUT SET (setpoint of the coolant temperature at the outlet) and TCO DELTA SET (setpoint of the difference of the coolant temperatures at the outlet and inlet). These setpoint signals are routed to a controller 10 together with the actual value signals TCO-OUT MES and TCO_INP MES. The controller 10 generates—in a manner still to be described—as a function of these as well as other input signals, output signals CMF_CTR and COC_CTR that are routed via incremental elements 11, 12 and limiting elements (SATURATION) to generate the adjusting signal CMF to adjust the coolant pump 3 or the adjusting signal COC to adjust the bypass valve 4. In the incremental elements 11 and 12 signals can be superimposed on output signals CMF_CTR and COC_CTR of controller 10 in the case of abrupt changes to the setpoint, as explained in greater detail below.

Figure 3:
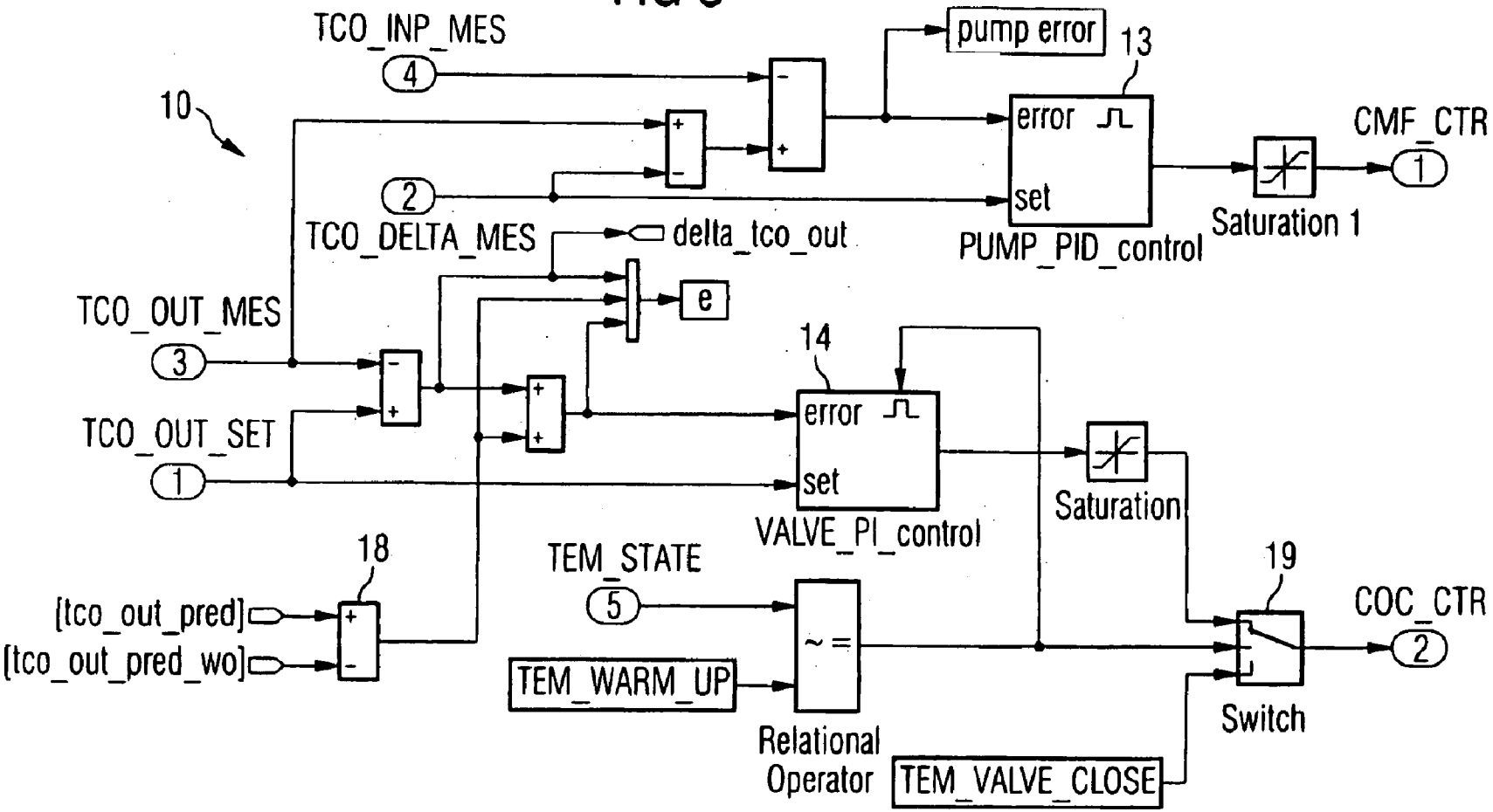
FIG. 3 shows a block schematic of a controller used in the control system of FIG. 2.

The controller 10, shown in greater detail in FIG. 3, includes a control element 13 as a PID element that, as a function of the actual and setpoint signals TCO_OUT_MES, TCO_INP_MES and TCO_DELTA_SET, generates the output signal CMF_CTR from which the pump adjusting signal CMF is formed.

Controller 10 also includes a control element 14 in the form of a PI or PID element which generates the output signal COC_CTR from which the valve adjusting signal COC is formed depending on the corresponding input signals. However, the error input signal of the control element 14 is not measured with the actual values of the coolant temperature at the outlet (TCO OUT), but formed with predicted actual value signals TCO_OUT_PRED and TCO_OUT_PRED_WO which are logically connected in an element 18. Control element 14 actually forms part of a Smith controller as explained in greater detail below.

As previously stated, Smith controllers are known. They serve to take account of long idle times of the system during the regulation process. In the case of coolant circuit 1 shown, the idle times are, on the one hand, determined by the duration of the coolant flow in the lines and, on the other hand, by the duration of the heat transfer between the internal combustion engine 2 and the coolant.

In order to generate the signals TCO_OUT_PRED and TCO OUT_PRED_WO fed to element 18, the output signals CMF and COC of controller 10 are fed back, delayed by one scanning cycle (unit delay), to an observer 15, see the block diagram of FIG. 2. Observer 15 continuously estimates the idle time of the system. As mentioned above, the idle time includes a first component that emanates from the flow of the coolant through the lines and a second component that emanates from the heat dissipation of the internal combustion engine. The first part is estimated as a function of the pump adjusting signal CMF that represents a measurement for the coolant flow. The second part is estimated as a function of the heat dissipation of the internal combustion engine. The heat dissipation depends on the rotational speed and the volumetric efficiency of the internal combustion engine. Observer 15 estimates these values as a function of the input signals N 32 (rotational speed), TQI (torque), TIA (temperature of the air in the intake tract) and TEG_DYN (waste gas temperature).

To a certain extent observer 15 represents a model for the coolant circulation and the heat dissipation of the internal combustion engine by means of which a system can be simulated without the estimated idle time. With its assistance, the output signals TCO_OUT_PRED and TCO_OUT_PRED_WO are generated which are estimated actual value signals for the coolant temperature at the outlet for an assumed system with and without idle time. Element 18 links these two signals (FIG. 3) to generate the estimated error signal for the control element 14.

In this way, the control element 14 and the observer 15 together form a Smith controller in which case the control element 14 generates the adjusting signal COC for the bypass valve under due consideration of the idle time of the system.

The control system of FIG. 2 also includes means to reduce the idle time in the event of a short load jump as takes place, for example, during overtaking. If there is a corresponding load jump, the setpoint for the coolant temperature is then suddenly reduced at the outlet of the internal combustion engine (TCO_OUT_SET), for example, from 110° to 80° to increase the delivery rate of the internal combustion engine, i.e. to obtain a better cutoff and thereby a higher torque.

Observer 15 detects this kind of quick setpoint change of the coolant temperature and signals this by means of an output signal TCO_OUT_DOT to a pre-controller 16. An operating state signal TEM STATE that signals operating states of the internal combustion engine such as, for example, the heating phase etc., is also fed to the pre-controller 16 from a block 17. The pre-controller 16 to which further input signals are still fed that are not shown, is embodied as a PD element that, as a function of the corresponding input signals, generates the pre-controller signals CMF_PRECTR for the adjusting signal CKF of the pump and COC_PRECTR for the adjusting signal COC of the bypass valve. Here, the D component of the PD element takes care of a corresponding advance that, on the basis of linking the signal CMF_PRECTR to the control output signal CMF_CTR via the incremental element 11, takes care of increasing the rotational speed of the coolant pump for a short time.

Figure 4:
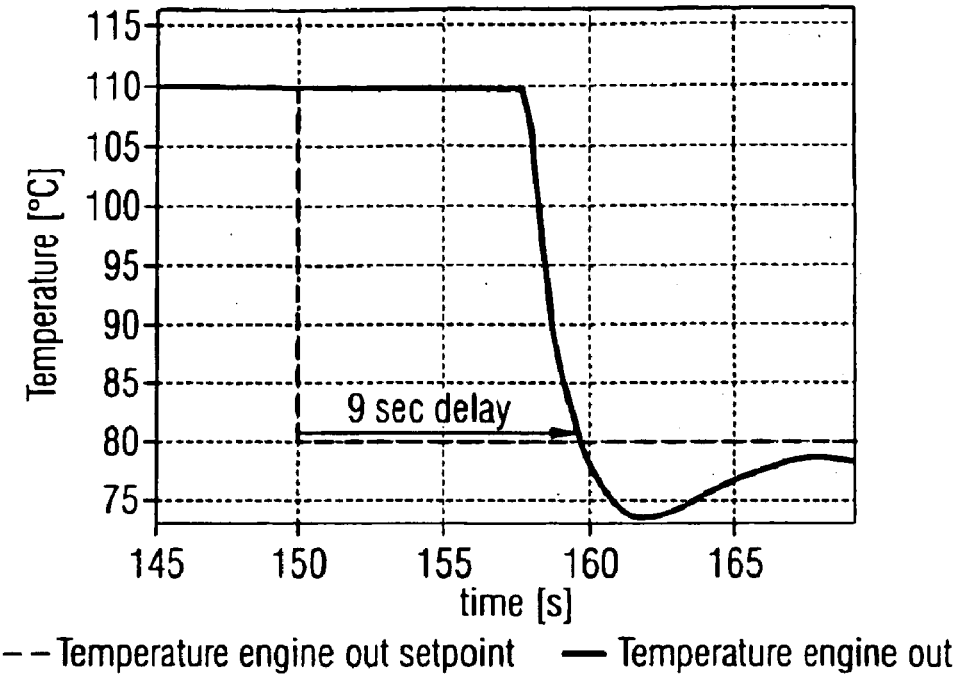
FIGS. 4 and 5 show coolant temperatures plotted over a period of time.
Figure 5:
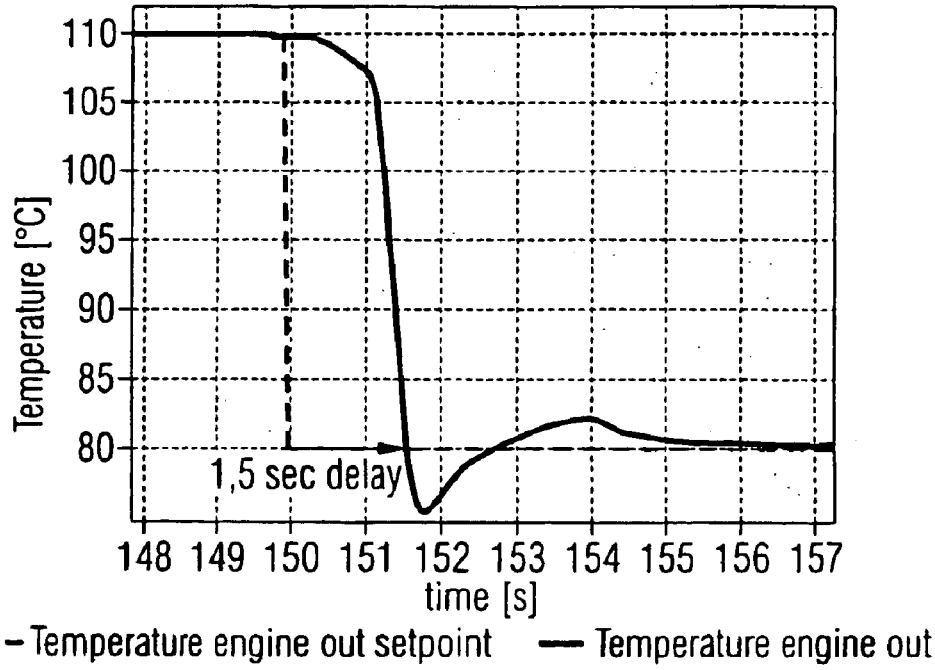

As the investigations have shown, the idle time can be reduced by a factor of 7 in this way. This is illustrated in FIGS. 4 and 5. FIG. 4 shows a diagram of a controller without the pre-controller 16 in which lowering the setpoint of the coolant temperature, for example, from 110° to 80° results in an idle time of 9 sec. until the measured coolant temperature has reached the value of 80°. FIG. 5 shows a corresponding diagram for a controller with the pre-controller 16. Increasing the pump rotational speed for a short time reduces the idle time to 1.5 sec.

As indicated in FIG. 2, the pre-controller 16 can also generate a pre-control signal COC_PRECTR that is superimposed in the incremental element 12 by the control signal COC_CTR for the bypass valve. However, the pre-control signal COC_PRECTR can also be made zero in a simple embodiment.

List of abbreviations used in FIGS. 2 and 3

TCO=Coolant temperature

OUT=Outlet of the internal combustion engine

INP=Inlet of the internal combustion engine

MES=Measured actual value

SET=setpoint
TCO_DELTA=(TCO_OUT)-(TCO_INP)
TEM_STATE=Operating state signal
CMF=Adjusting signal for coolant pump
COC=Adjusting signal for bypass valve
CTR=Controller
PRECTR=Pre-controller
N-32=Rotational speed of the internal combustion engine
TQI=Torque of the internal combustion engine
RAD=Radiator
DOT=Delivery offtake
TIA=Temperature of the air in the intake tract
TEG_DYN=Exhaust temperature

What is claimed is:

1. A method for controlling a coolant temperature in an internal combustion engine coolant circuit with an electrically driven coolant pump and an electrically controllable bypass valve which routes a variable part of the coolant flow through a bypass line including a radiator comprising:

controlling, a rotational speed of the coolant pump and a position of the bypass valve as a function of the coolant temperature at an outlet of the internal combustion engine and by a difference between the coolant temperatures at the outlet and inlet of the internal combustion engine; and in the event of abrupt changes to the setpoint of the coolant temperature, increasing the rotational speed of the coolant pump for a short period of time.

2. The method according to claim 1, wherein the control of the rotational speed of the coolant pump includes a pre-controller which increases the rotational speed for a short period of time.

3. The method according to claim 2, wherein a PD element is used as the pre-controller.

4. A method for controlling a coolant temperature in an internal combustion engine coolant circuit with an electrically driven coolant pump and an electrically controllable bypass valve that routes a variable part of the coolant flow through a bypass line including a radiator comprising:

controlling a rotational speed of the coolant pump and a position of the bypass valve as a function of the coolant temperature at an outlet of the internal combustion engine and by the difference between the coolant temperatures at the outlet and inlet of the internal combustion engine;

wherein a Smith controller controls the position of the bypass valve by means of an observer as a model for the coolant circuit and the heat dissipation of the internal combustion engine, and continuously estimates an idle time of the system to generate estimated coolant temperature values of an assumed system without idle time that is used to control the valve position.

5. The method according to claim 4, wherein the idle time is estimated as a function of the coolant flow and the heat dissipation of the internal combustion engine.

6. The method according to claim 5, the heat dissipation of the internal combustion engine is estimated as a function of the rotational speed and the volumetric efficiency of the internal combustion engine.

7. The method according to claim 5, wherein the Smith controller has a control element as a PI or PID element that generates an adjusting signal for the bypass valve as a function of the estimated coolant temperature values.

* * * * *